United States Patent [19]

Barkley

[11] 4,321,884

[45] Mar. 30, 1982

[54] COATING THICKNESS CONTROL NOZZLE

[75] Inventor: Harold K. Barkley, Colliers, W. Va.

[73] Assignee: National Steel Corporation, Pittsburgh, Pa.

[21] Appl. No.: 227,201

[22] Filed: Jan. 22, 1981

[51] Int. Cl.[3] ..... B05C 11/06

[52] U.S. Cl. ..... 118/63; 118/419; 427/349

[58] Field of Search ..... 118/63, 419, 21; 427/348, 349; 34/152, 155, 160; 239/589, 592, 593, 594; 15/306 A, 418, 415 R

[56] References Cited

U.S. PATENT DOCUMENTS

| | | | |
|---|---|---|---|
| 3,141,194 | 7/1964 | Jester | 18/15 |
| 3,314,163 | 4/1967 | Kohler | 34/155 |
| 3,499,418 | 3/1970 | Mayhew | 118/4 |
| 3,917,888 | 11/1975 | Beam et al. | 427/433 |
| 4,041,895 | 8/1977 | Overton et al. | 118/7 |
| 4,078,103 | 3/1978 | Thornton et al. | 427/349 |

*Primary Examiner*—Ralph S. Kendall

*Attorney, Agent, or Firm*—Paul T. O'Neil; James L. Bean

[57] ABSTRACT

An improved nozzle structure for directing a wide, thin jet stream of a gaseous medium from an outlet nozzle opening onto the surface of a running length of a flexible substrate or strip emerging from a liquid coating bath provides more accurate control of the thickness and the distribution of the coating liquid. The nozzle structure has a plurality of elongated, parallel plenum chambers each having its length dimension extending transversely of and being at least substantially as great as the width of the strip being coated. Gaseous fluid is supplied under pressure to the nozzle structure through a plurality of inlet openings spaced along the length dimension of one plenum chamber and uniform, narrow slot openings along substantially the full length of the chambers provides fluid communication between successive chambers from the inlet to the outlet nozzle whereby substantially uniform pressure is obtained along the full length of the narrow outlet nozzle.

15 Claims, 5 Drawing Figures

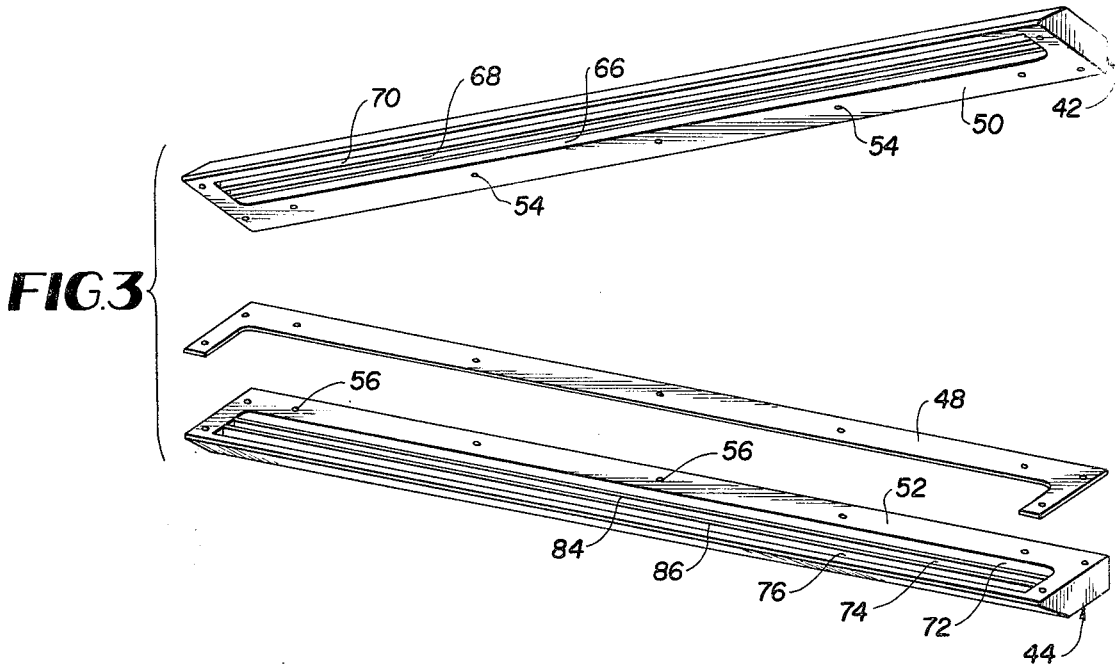
FIG.3
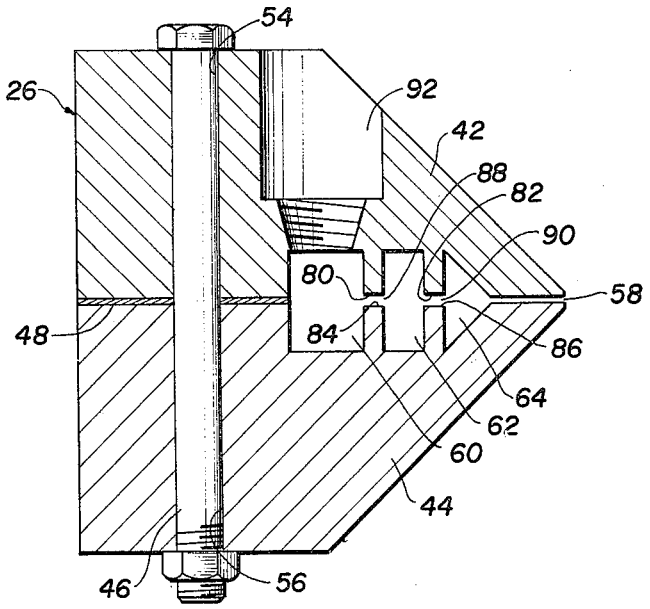
FIG.5
FIG.4
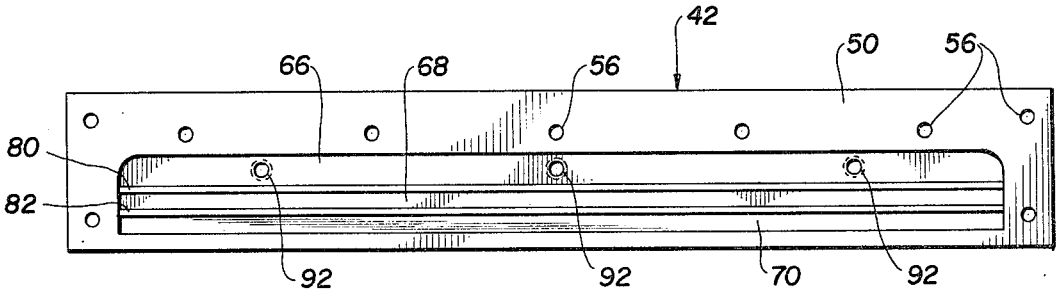

COATING THICKNESS CONTROL NOZZLE

BACKGROUND OF THE INVENTION

1. Field of the Invention

This invention relates to hot liquid coating apparatus and more particularly to an improved fluid nozzle assembly for directing a controlled, thin flat stream of a gaseous fluid onto the surface of a running length of a substrate emerging from a liquid coating bath to wipe the coating liquid from the surface of the substrate to produce a controlled, uniform coating. The nozzle assembly is particularly well adapted for hot dip coating metal strip such as the continuous galvanizing of steel wherein the nozzle assembly is located in a very high temperature environment.

2. Description of the Prior Art

The use of a thin, wide jet of fluid to wipe excess coating fluid from a moving substrates has long been known in the paper coating art, and has more recently been widely accepted in the hot dip coating of metal substrates. Since the nozzle structure of the present invention is particularly well adapted for use in the hot dip galvanizing of metal strip, it will be described herein with reference to such a process, it being understood that the nozzle structure may also be used in other coating operations.

In the hot dip galvanizing of strip steel a fluid such as stream, air, or a mixture of steam and air is directed against the strip surface after it emerges from the spelter bath and while the coating material is still in the liquid state. Normally, two nozzles are employed one on each side of the substrate, with the jet streams being directed in substantially opposed relation so that forces applied to the strip by the fluid jets are substantially equalized. The wide, thin nature of the jet streams extending across the full width of the substrate being coated results in the nozzles normally being referred to as air knives, although the fluid impinging on the moving substrate is believed to act more in the nature of a dam preventing excess coating material from being carried through than a knife or blade which strips the liquid from the substrate.

While the use of air knives has largely replaced the older technique of coating rolls in the hot dip coating of metals, it has not always been possible to achieve the desired accuracy in controlling both the thickness and distribution of the coating material due, in part, to the necessity for accurately controlling various parameters, well known in the art, which affect both distribution and coating thickness. This has been made more difficult by the high temperatures encountered by the nozzle structures which of necessity must be placed very close to the hot dip bath where temperatures are very high. Also, the steam or air conventionally used in hot dip galvanizing processes is maintained at a relatively high temperature to avoid excessive cooling of the coating material. The heat to which the nozzle assemblies are subjected in such an operation has frequently resulted in distortions of the structure and produced an uneven distribution of the gaseous medium across the strip width.

It has been proposed, for example in U.S. Pat. No. 4,041,895 to Overton et al. and U.S. Pat. No. 3,917,888 to Beam et al., to provide a nozzle structure having an enlarged internal plenum chamber into which the wiping fluid is discharged, and to provide perforated baffle plates, screens, guide vanes and the like in the enlarged plenum chamber between the fluid inlet and the nozzle outlet in an effort to produce a more uniform pressure, and therefor more uniform fluid flow from the nozzle across the full width of the outlet. However, the use of separate baffle plates, screens, and the like inserted in the interior of the enlarged cavity necessarily results in a complex nozzle structure assembled from a plurality of components of widely differing shapes assembled together with threaded fasteners. Such complex, assembled structure can tend to aggravate the differential expansion and thermal distortion problems, mentioned above.

U.S. Pat. No. 3,141,194 to Jester discloses an air knife structure employed to direct air onto the surface of a film or synthetic resin material on a casting drum. The air knife structure employs a plenum chamber with two sections joined along their length by a relatively wide slot and a second wide slot leads to a converging nozzle structure which reduces turbulence in the air leading to the exit nozzle.

U.S. Pat. No. 4,078,103 to Thornton et al. discloses a metal strip coating apparatus employing an air knife for directing a stream of air onto the surface of the substrate to control thickness and distribution of the molten metal. The nozzle structure employs a pair of opposed inlet chambers each having an elongated outlet slot extending substantially throughout its length for discharging air under pressure into a common plenum chamber. The plenum chamber has a so-called "bow tie" shaped outlet nozzle for directing the air onto the surface of the strip as it emerges from the hot dip bath. Shims between the two nozzle sections are employed to control the outlet nozzle size. The outlet slots from the inlet chambers are in closely spaced, opposed relation so the streams impinge directly on one another, thereby creating substantial flow resistance and turbulence.

SUMMARY OF THE INVENTION

While the air knives or nozzle structure of the foregoing and other prior art patents represent a substantial improvement over the previously employed coating roll apparatus for controlling the coating thickness and distribution in hot dip coating operations, and particularly in hot dip galvanizing operations, they have not been entirely satisfactory in controlling either the coating thickness or the distribution of the coating material across the width of the running length of substrate. In accordance with the present invention, the deficiencies of the prior art nozzle devices are overcome by providing a relatively simple, high strength, dimensionally stable nozzle structure which reliably and accurately provides a uniform gas pressure and flow rate from the nozzle structure even in the high temperature atmosphere of a hot dip galvanizing operation.

In the preferred embodiment of the present invention, the nozzle structure includes a pair of elongated dies or nozzle half-sections of unitary construction, with the two dies being substantially mirror images of one another and retained in rigid assembled relation by a plurality of threaded fastener members. The respective dies are formed with a plurality of elongated cavities in their opposing surfaces, with the cavities cooperating, when assembled, to form inlet, intermediate and outlet plenum chambers, with respective plenum chambers communicating with one another through elongated, narrow slots extending substantially the full length of the chambers. Preferably, the plenum chambers decrease in volume progressively from the inlet to the outlet although this arrangement is not essential to operation of the nozzle assembly. The long narrow slot openings between adjacent plenum chambers produce a flow restriction, and a consequent pressure drop, from chamber to chamber with the result that pressure is substantially completely equalized throughout the length of the outlet plenum chamber and uniform flow is achieved from the outlet nozzle. Further, the unitary construction of the nozzle dies provides a dimensionally stable, rigid structure so that flow is not materially affected by the high temperature environment of a hot dip coating operation or by the high temperature of the gaseous fluid flowing therethrough.

BRIEF DESCRIPTION OF THE DRAWINGS

The foregoing and other objects and advantages of the invention will become apparent from the detailed description contained hereinbelow, taken in conjunction with the drawings, in which:

FIG. 3 is an exploded view, in perspective, of a nozzle embodying the present invention;

FIG. 4 is bottom plan view of the upper half section of the nozzle structure shown in FIG. 3; and FIG. 5 is a sectional view, taken on line 5—5 of FIG. 1.

DESCRIPTION OF THE PREFERRED EMBODIMENT

Figure 2:
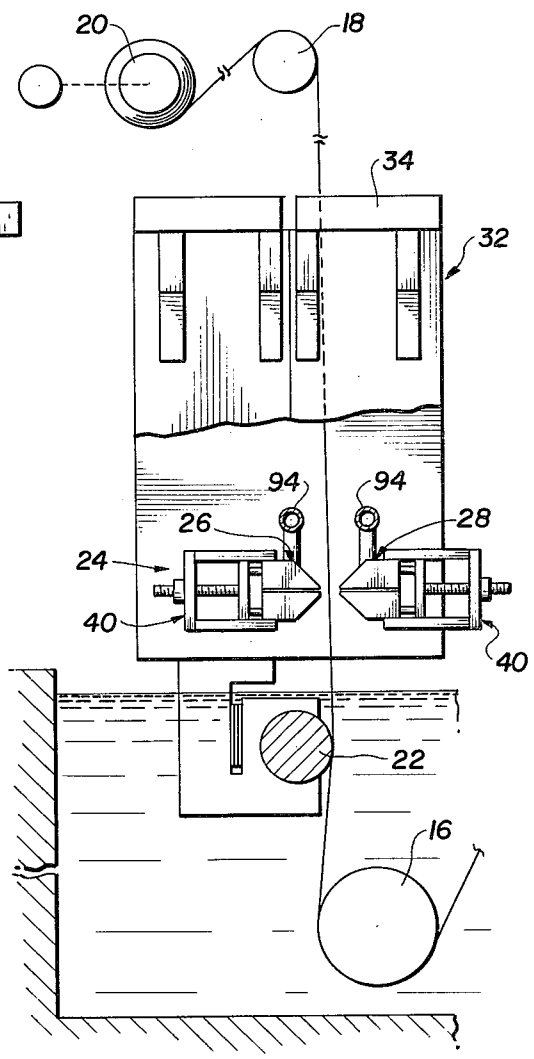
FIG. 2 is a fragmentary side elevation view, taken on line 2—2 of FIG. 1, with certain parts broken away to better illustrate the invention.
Figure 1:
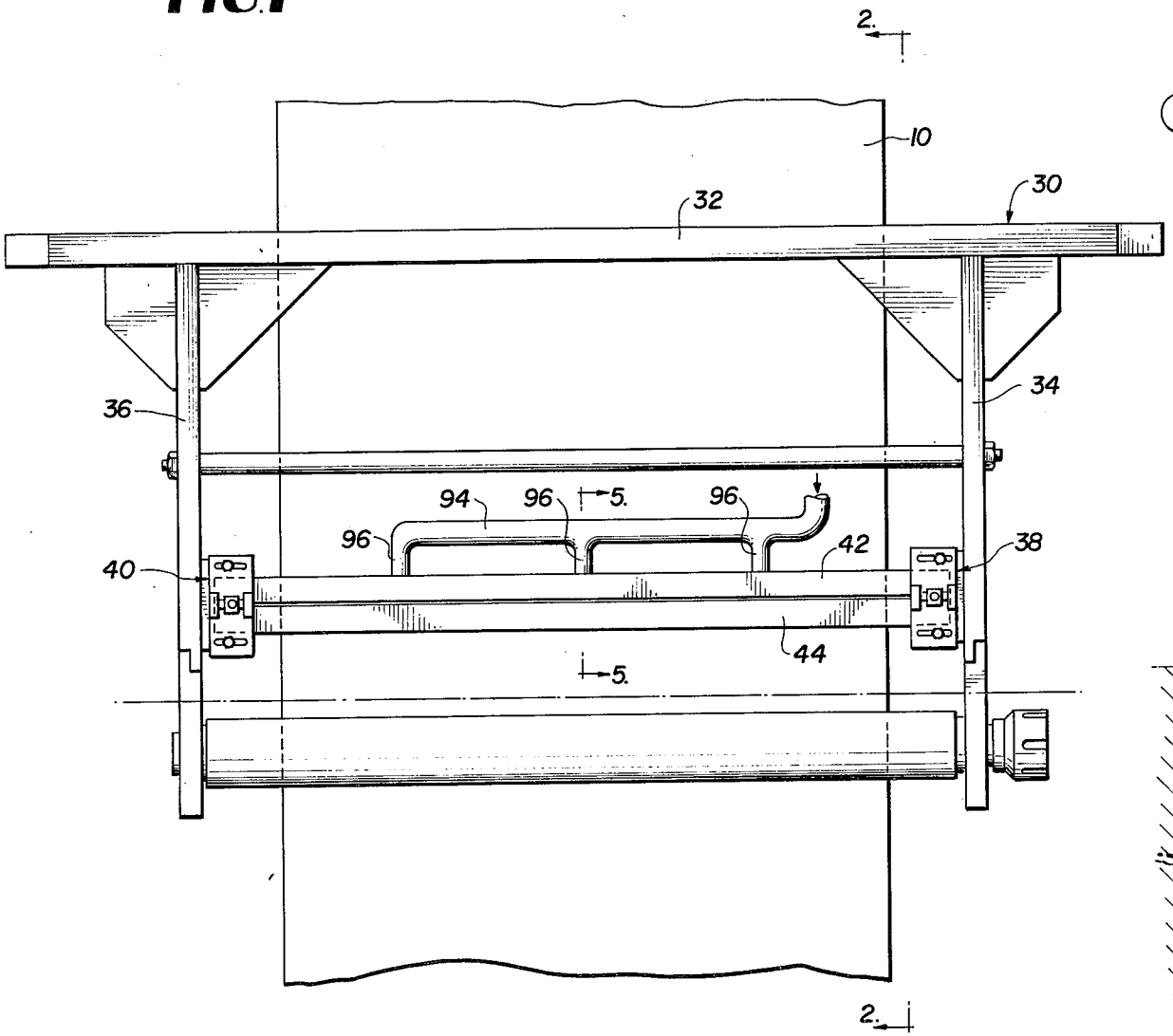
FIG. 1 is a fragmentary view, in elevation, of a hot dip coating system embodying the improved coating control nozzle of the present invention.

Referring now to the drawings in detail, and especially to FIGS. 1 and 2, a running length of steel strip 10 is shown passing through a galvanizing pot 12 containing a molten zinc, or spelter bath 14 in a hot dip galvanizing operation. The path of travel of the strip 10 is established by a sequence of guide rolls around which the strip is led. The guide rolls include a sink roll 16 within the spelter bath and an idler roll 18 positioned far enough above the bath so that the molten spelter on the strip has solidified by the time strip 10 reaches this elevation. A motor driven coiler 20 draws the strip through the apparatus, and a stabilizing roll 22 near the surface of the spelter bath presents the strip in a planar, stable form to a coating thickness control apparatus indicated generally by the reference numeral 24. Strip 10 is thus guided through the coating thickness control apparatus in uniform spacing between the opposed coating nozzle assemblies 26, 28.

A liquid coating thickness control system including nozzles of the general type employed in the present invention, and the operation thereof, are described in detail in U.S. Pat. No. 3,499,418, the disclosure of which patent in this respect is incorporated herein by reference. Briefly, however, strip 10 passes upwardly from the spelter bath and carries on its surface a layer, or coating of molten zinc. However, due to various factors, substantial excess coating material is carried out of the bath by the strip, and the thickness of the coating on the two sides of the strip is controlled by the wiping action of pressurized gaseous fluid directed onto the surface of the strip by the nozzles 26, 28. This wiping of excess coating metal back into the spelter bath is affected in accordance with the basic principles taught in U.S. Pat. No. 3,499,418.

Coating control nozzles 26 and 28 form a part of the coating thickness control assembly which includes a nozzle support frame structure 30 having a horizontal support platform 32 supporting a pair of downwardly depending legs 34, 36 for supporting the nozzles. A pair of adjustable brackets 38, 40 mounted on legs 34, 36, respectively, support nozzle 26 and a similar pair of support brackets support nozzle 28. Since the nozzles are preferably identical, only the nozzle assembly 26 will be described in detail, it being understood that the description applies to both nozzles.

Referring now to FIGS. 3–5, it is seen that nozzle 26 comprises an elongated body assembly made up of upper and lower die members 42, 44, respectively, retained in rigidly assembled relation by a plurality of bolts 46. An elongated shim member 48 extends between the back and end portions of the die members 42, 44 to retain them in fixed, spaced relation relative to one another. As will be understood, shims of various thicknesses may be employed, as desired, to accurately control the spacing of the die members.

Upper and lower die members 42, 44 are each formed from a single, elongated piece of metal of substantially identical configuration, with die 42 having a substantially flat surface 50 which is substantially the mirror image of a corresponding surface 52 on die member 44, with the surface 50 and 52 being retained in opposed spaced relation by the shim 48. A plurality of openings 54 are formed in die 42 and a similar number of openings 56 formed in die 44 for receiving the clamping bolts 46. In the embodiment illustrated the thickness of shim 48 defines the width, measured normal to the surfaces 50, 52, of the nozzle outlet 58; however, it is believed apparent that the surfaces defining the nozzle outlet 58 may be slightly recessed or may be contoured if a non-uniform flow is desired to produce a differential coating thickness.

A plurality of elongated channels are formed, as by milling, into the surfaces 50 and 52 of dies 42, 44, respectively, with the channels in the two die members cooperating to define three distinct, spaced plenum chambers including an inlet chamber 60, an intermediate chamber 62, and an outlet chamber 64 as most clearly seen in FIG. 5. Thus, as shown in FIG. 4, die member 42 has a first, relatively wide generally rectangular channel 66 milled in the surface 50 along substantially the longitudinal center line of the die. A second generally rectangular channel 68 extends in parallel spaced relation to channel 66 on the side thereof closest outlet nozzle 58, and a third, substantially triangular channel 70 extends parallel to channels 66, 68 and on the side of thereof closest nozzle 58. In the preferred embodiment, the channel 66 has a cross sectional area approximately twice that of channel 68, and channel 68 has a cross sectional area substantially twice that of channel 70. It should be understood, however, that this size ratio is not essential to the invention.

Similar channels 72, 74 and 76 are formed in the flat surface 52 of die 44. Rectangular channel 72 corresponds with and is opposed to channel 66 in the assembled nozzle, while rectangular channel 74 corresponds with and is opposed to rectangular channel 68 and triangular channel 76 is opposed to and corresponds with triangular channel 70. Thus, channels 66 and 72 cooperate to define the inlet plenum chambers 60 while channels 68 and 74 define the intermediate plenum chamber 62 and triangular channels 70 and 76 cooperate to define the outlet plenum chamber 64. Also, as best seen in FIG. 5, the ledges between adjacent channels are preferably slightly recessed from the surfaces 50, 52 respectively, to provide lands 80,82 on surface 50 and lands 84, 86 on surface 52. Lands 80 and 84 cooperate to define a first narrow, elongated slot-like channel, or nozzle 88, and lands 82 and 86 cooperate to form a second such channel 90. Channels 88 and 90, respectively, provide communication between plenum chambers 60 and 62 and plenum chambers 62 and 64, respectively. In an embodiment of the invention presently in operation in a hot dip galvanizing line, lands 80, 82, 84 and 86 are recessed 0.010 inches from the die surface so that the channels 88 and 90 are 0.020 inches wider than the outlet nozzle 58. Outlet 58 may be about 0.015 inches, although this dimension may be varied as desired by inserting a shim 48 of a different thickness. Preferably, the total width of channels 88 and 90 are at least about twice the width of the nozzle outlet.

Die member 42 is provided with a plurality of tapped openings 92 communicating with the inlet plenum 60 at spaced intervals along its length, there being three such openings illustrated in the drawing. As indicated schematically in FIGS. 1 and 2, a manifold 94 extends above each nozzle assembly and conduits 96 connected with the manifold 84 are threadably received in the tapped openings 92 to supply heated gaseous fluid under pressure to the respective nozzle assemblies in the manner described in U.S. Pat. No. 3,499,418 mentioned above.

Since the two die members 42, 44 of each nozzle assembly are substantially identical except for the three openings 92 in the top die member 42, and further since each die member is integrally formed from a single piece of dimensionally stable, high strength metal, the nozzle assemblies are very stable in the high temperature atmosphere in which they are normally used. Since the nozzle assemblies are substantially unaffected, except for normal and predictable expansion, the nozzle opening 58 remains substantially unaffected by dimensional changes caused by temperature changes in the structure and accordingly an accurate control of the nozzle geometry is maintained.

By using three separate, independent plenum chambers in the nozzle assembly, and by permitting communication between the chambers through thin, elongated slot-like channel openings which produce a predictable pressure drop from plenum chamber to plenum chamber, an extremely uniform fluid pressure is achieved throughout the length of the nozzle assembly at the nozzle outlet 58. Further, since the pressure equalization is in distinct stages, the total pressure drop from the inlet chamber to the outlet chamber can be relatively small and still achieve the desired uniform flow rate through the outlet nozzle along its full length.

As is clearly seen in FIGS. 3–5, the wiping fluid enters the inlet plenum 60 at a plurality of fixed positions along the length of the nozzle. The restricted outlet provided by the elongated slot opening 88 results in flow within this chamber longitudinally of the nozzle assembly so that the fluid flows from the inlet plenum 60 to the intermediate plenum 62 along the full length of the slot 88 rather than to be channeled from the respective inlet opening 92 directly towards the outlet nozzle 58. Since pressure is substantially equalized throughout the length of the nozzle in intermediate plenum 62, the size or cross sectional area of this plenum may be reduced since little longitudinal flow will take place in this chamber. A further reduction in the chamber size is made in the outlet plenum 64, and the geometry of this outlet plenum is such as to reduce the resistance to flow and facilitate a uniform flow outwardly through the nozzle 58.

The use of the nozzle assembly described above on a commercial hot dip galvanizing line has resulted in extremely uniform coating thickness along the length of the continuously moving substrate as well as a highly uniform distribution of the metal coating thickness transversely of the strip.

While the embodiment of the invention described employs a uniform outlet nozzle to produce a jet of a gaseous wiping fluid across, which is substantially uniform across the full width of the moving substrate, it is understood that the surface contour defining the nozzle outlet opening 58 may be changed if desired to produce a non-uniform coating transversely of the width dimension of the strip being coated. The same degree of control of coating thickness and distribution may be achieved using the apparatus just described, regardless of whether or not a uniform distribution transversely of the strip is desired.

While I have disclosed and described a preferred embodiment of my invention, I wish it understood that I do not intend to be restricted solely thereto, but rather that I do intend to include all embodiments thereof which would be apparent to one skilled in the art and which come within the spirit and scope of my invention.

I claim:

1. In a coating apparatus in which a coating liquid is applied to an imperforate substrate in strip form by passing the substrate through a bath of the coating liquid, withdrawing the substrate upwardly from the bath with an excess of the coating liquid adhering to the surfaces thereof, then removing the excess coating liquid by passing the substrate between and in closely spaced relation to a pair of opposed nozzles and discharging a wide, thin jet of gaseous fluid under pressure from each such nozzle to impinge against the surfaces of the moving substrate to wipe excessive coating liquid from the substrate, the improvement wherein each such nozzle comprises, a pair of elongated die members having their length dimension transversely of the length of the substrate, said die members being assembled together and cooperating to define an elongated nozzle body having an outlet opening extending at least substantially the full width of the substrate, a plurality of separate plenum chambers formed in and extending longitudinally of said body between said die members, said plenum chambers each having a length substantially equal to the length of said outlet opening and extending in spaced, parallel relation to one another, at least one inlet opening formed in one of said die members and communicating with one of said plenum chambers for admitting a gaseous fluid under pressure into said nozzle body, said outlet opening communicating with another of said plenum chambers throughout substantially its full length, and elongated, narrow fluid channel means extending between and providing fluid communication between successive plenum chambers throughout substantially their full length from said at least one inlet opening to said outlet opening, said fluid channel means being of substantially uniform cross-section throughout substantially their full length.

2. The coating apparatus according to claim 1 wherein each said plenum chamber has a portion of its volume contained within each of said die members.

3. The coating apparatus according to claim 1 wherein each said die member is formed from a single piece of structural metal.

4. The coating apparatus according to claim 1 further comprising removable shim means mounted between said die members, the thickness of said shim means being selected to accurately control the dimension of said outlet opening and of said narrow fluid channel means.

5. The coating apparatus according to claim 1 wherein each said plenum chamber is defined by a pair of similar elongated channels formed one in an inner surface of each die member, said inner surfaces being assembled with the elongated channels of each such pair being in opposed relation to one another.

6. The coating apparatus according to claim 5 wherein each said nozzle comprises an inner plenum chamber, an intermediate plenum chamber, and an outlet plenum chamber, and wherein said fluid channel means comprises a first elongated narrow channel providing communication between said inlet and said intermediate plenum chambers throughout substantially their full length and a second elongated narrow channel providing communication between said intermediate and said outlet plenum chambers throughout substantially their full length.

7. The coating apparatus according to claim 5 wherein each said die member is formed from a single piece of structural metal.

8. The coating apparatus according to claim 5 further comprising removable shim means mounted between said die members, the thickness of said shim means being selected to accurately control the dimension of said outlet opening and of said narrow fluid channel means.

9. The coating apparatus according to claim 1 wherein each said nozzle comprises an inner plenum chamber, an intermediate plenum chamber, and an outlet plenum chamber, and wherein said fluid channel means comprises a first elongated narrow channel providing communication between said inlet and said intermediate plenum chambers throughout substantially their full length and a second elongated narrow channel providing communication between said intermediate and said outlet plenum chambers throughout substantially their full length.

10. The coating apparatus according to claim 9 wherein each said die member is formed from a single piece of structural metal.

11. The coating apparatus according to claim 10 further comprising removable shim means mounted between said die members, the thickness of said shim means being selected to accurately control the dimension of said outlet opening and of said narrow fluid channel means.

12. The coating apparatus according to claim 9 wherein the volume of said outlet plenum chamber is substantially less than the volume of said inlet plenum chamber.

13. The coating apparatus according to claim 12 wherein the volume of said plenum chambers decrease progressively from said inlet plenum chamber to said outlet plenum chamber.

14. The coating apparatus according to claim 13 wherein the volume of said intermediate plenum chamber is about one half of said inlet plenum chamber, and wherein the volume of said outlet plenum chamber is about one half of that of the intermediate plenum chamber.

15. The coating apparatus according to claim 14 wherein the width of said narrow fluid channel means is about twice the width of said outlet opening.

* * * * *